United States Patent [19]

Leibee et al.

[11] 3,960,222

[45] June 1, 1976

[54] TOOL FOR CUTTING GROOVE IN HOLE

[75] Inventors: Donald L. Leibee, Bedford; Seibert S. Oaks, Everett; R. Douglas Evans, Jr., Bedford, all of Pa.

[73] Assignee: Kennametal Inc., Latrobe, Pa.

[22] Filed: Aug. 29, 1974

[21] Appl. No.: 501,803

[52] U.S. Cl. ..... 175/263; 61/45 B

[51] Int. Cl.[2] ..... E21B 9/26

[58] Field of Search ..... 61/45 B, 53.52; 175/263, 273, 384, 382, 292

[56] References Cited

UNITED STATES PATENTS

| | | | |
|---|---|---|---|
| 111,099 | 1/1871 | Walch | 175/384 X |
| 564,510 | 7/1896 | Elliott | 175/384 X |
| 945,016 | 1/1910 | Caldwell | 175/384 |
| 1,681,651 | 8/1928 | Woodruff | 175/263 |
| 1,705,055 | 3/1929 | Allison | 175/263 |
| 2,193,721 | 3/1940 | Gunderson | 175/263 |
| 2,599,167 | 6/1952 | Dionisotti | 175/263 |
| 2,771,746 | 11/1956 | Fischer et al. | 61/45 B |
| 3,250,075 | 10/1966 | Webb et al. | 61/45 B X |
| 3,422,629 | 1/1969 | Watts | 61/53.52 |

FOREIGN PATENTS OR APPLICATIONS

| | | | |
|---|---|---|---|
| 987,666 | 4/1951 | France | 175/263 |

*Primary Examiner*—Dennis L. Taylor
*Attorney, Agent, or Firm*—Melvin A. Crosby

[57] ABSTRACT

A tool for being inserted in a hole, especially a hole in an earth formation, and adapted for being rotated in the hole. A cutting element moveably mounted on the tool is provided for cutting a groove in the hole and, if the tool is moved axially in the hole while rotating, a helical groove will result. The cutting element is retractable to permit removal of the tool from the hole. The hole with the groove formed therein is adapted for receiving a roof bolt or the like which is cemented in place and the aforementioned groove improves the strength with which the bolt is held in the hole.

10 Claims, 25 Drawing Figures

TOOL FOR CUTTING GROOVE IN HOLE

The present invention relates to a special tool, especially for use in mining, and is particularly concerned with a tool adapted for forming at least one groove in a hole.

In mining operations and the like, it is often desirable or necessary to install bolts in holes, such as roof bolts, for supporting equipment and the like. Heretofore, roof bolts and the like were installed by drilling holes in the mine wall, and then inserting packets of the ingredients of a quick setting epoxy cement and then inserting the bolt to be secured in the hole.

The bolt would rupture the packets containing the ingredients of the epoxy cement and protrusions projecting from the bolt would mix the ingredients upon rotation of the bolt. The quick setting cement sets up very rapidly and the bolt is thereby held in place in the hole.

It is the case, however, that, many times, the bolts extend vertically into the roof of a mine shaft and are loaded in the vertically downward direction and will sometimes pull out of the holes in which they are placed due, principally, to the failure of the cement to attach properly to the periphery of the hole.

With the foregoing in mind, a primary object of the present invention is the provision of a tool for modifying the configuration of a hole in which a roof bolt or the like is to be mounted so that cementing material, such as epoxy cement, will grip the periphery of the hole and thereby strongly support the bolt therein.

Another object of the invention is the provision of a method of installing bolts in holes, especially in mines, in which the bolt becomes firmly anchored in the hole and can support heavy loads without pulling out of the hole.

BRIEF SUMMARY OF THE INVENTION

According to the present invention, a hole drilled in an earth formation, especially in a mine roof, has at least one groove formed therein by a tool consisting of a body slightly smaller than the hole and having a cutting element moveably mounted thereon which protrudes radially outwardly from the hole whereby rotating the tool in the hole will cause a groove to be formed in the hole. If the tool is moved axially in the hole while rotating, the groove will be a helical groove. However, one or more annular grooves can be formed in the hole by positioning the tool in axial position along the hole and rotating the tool in each such axial position.

As mentioned, the cutting element is moveable on the body of the tool and retracts when the tool is drawn from the hole, or is rotated in the reverse direction in the hole, so that the tool can be withdrawn from the hole without damaging the groove formed therein.

In one form which the invention takes, the cutting element is laterally tiltable on the body of the tool and in one tilted position projects laterally from the tool body and in another tilted position falls within the envelope of the tool body.

In another modification, the cutting element is rotatable on the forward end of the body at an eccentric location thereon, and when the body rotates in one direction, the cutting element rotates on the body so as to protrude therefrom while rotation of the body in the opposite direction will cause the cutting element to retract to within the envelope of the body.

The exact nature of the present invention will become more clearly apparent upon reference to the following detailed specification taken in connection with the accompanying drawings in which.

DETAILED DESCRIPTION OF THE INVENTION

Figure 1:
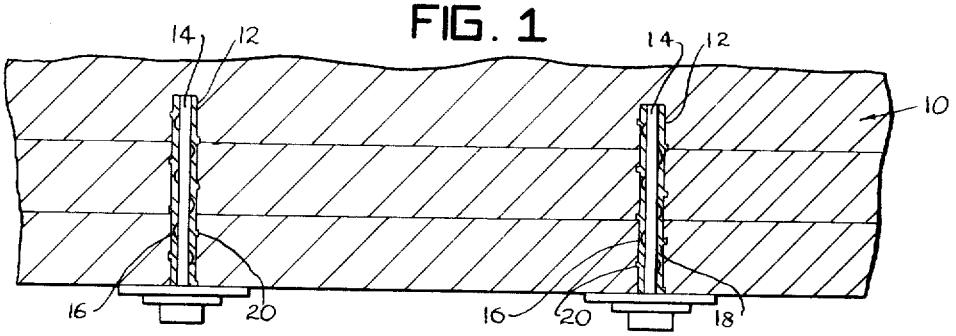
FIG. 1 is a somewhat schematic vertical sectional view showing a pair of roof bolts in place in the ceiling portion of a mine shaft.

Referring to the drawings somewhat more in detail, reference numeral 10 indicates a formation, especially an earth formation, and which may form the ceiling or roof of a mine shaft. The formation 10, as shown in FIG. 1, has two holes 12 formed therein by conventional rock drilling practices, and in each hole, there is disposed a roof bolt 14.

Each roof bolt has protrusions 16 distributed therealong, and in the space between the periphery of each bolt and the periphery of the respective hole, there is a body 18 of a cementing material such as epoxy cement.

In practice, the holes 12 are first drilled and then individual packets of the ingredients making up the cementing material are introduced into the hole and then the bolt 14 is pushed into the hole thereby rupturing the packets. The bolts are then rotated so that the protuberances 16 thereon mix the ingredients of the cementing material and the bolt is then held in place for a short period of time and during which the cementing material sets up and thereby holds the bolt in place.

It has been found that the holes 12 formed by conventional drilling practices are often so smooth that the cementing material does not have a firm enough grip on the surface of the hole to support a bolt 14 with sufficient strength.

To this end, the present invention proposes to provide each such hole with one or more annular grooves or a helical groove or undercut providing space into which the cementing material can flow and thereby forming a positive engagement of the cementing material with the surface of the hole.

Figure 2:
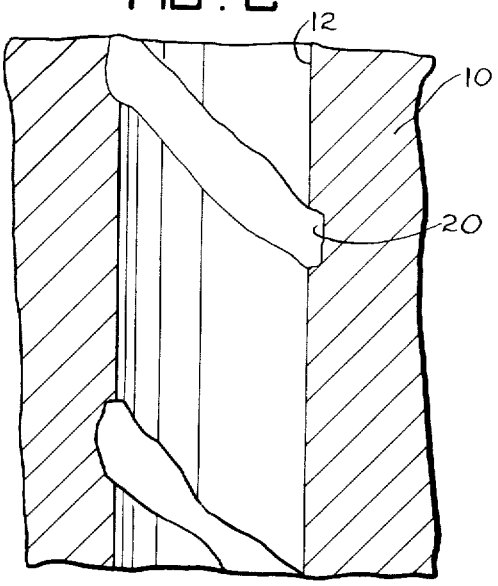
FIG. 2 is an enlarged fragmentary view showing a helical groove formed in the hole in which the bolt is to be placed.

The aforementioned groove, indicated as a helical groove at 20 in FIG. 1, is drawn at considerably enlarged scale in FIG. 2. In this figure, it will be seen that the groove is in the form of a relatively steep angled helix with the space between adjacent convolutions of the helical groove being several times, up to five times, the width of a respective groove.

The groove in cross section may be up to about one-fourth as deep as the diameter of the hole 12 in which it is formed. It will be understood that, in the natural course of events, the groove will vary in width and depth because it is usually formed in rock or the like and the foregoing proportions are merely representative of typical grooves.

As mentioned, one or more annular grooves, can be formed in a hole 12, as a combination of helical grooves and annular grooves could be formed in the hole. The important thing is to provide a recess, or undercut, in the hole with which the cementing material can interlock.

FIGS. 3 through 10 show in detail one tool according to the present invention. The tool of these figures comprises a body part 22 having a shank portion 24 at the rearward end for engagement with a driving instrumentality such as a chuck having a hex socket therein and connected to the output side of a drilling motor.

The forward end of the body has a transverse slot 26 extending axially inwardly into the body and mounted therein is a cutting element generally designated 28 and pivotally connected to the body by a pivot pin 30 which extends at right angles to the longitudinal axis of the tool body.

Figure 3:
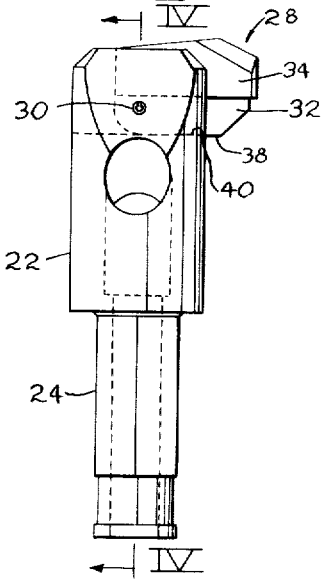
FIG. 3 is a side view of one form of a tool according to the present invention showing the cutting element protruding laterally therefrom.
Figure 4:
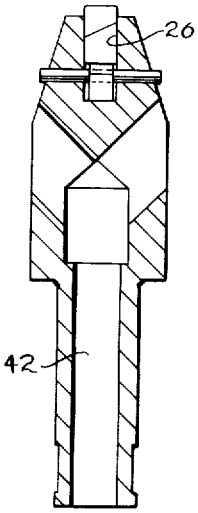
FIG. 4 is a vertical sectional view indicated by line IV—IV on FIG. 3.

The pin 30 is eccentrically located relative to the cutting element so that the cutting element can occupy a first position in which it is illustrated in FIG. 3 and wherein the outer end of the cutting element protrudes radially from the body 22. The cutting element can also occupy a second position in which it tilts upwardly in FIG. 3 about pivot 30 and thus falls substantially within the envelope of body 22.

Body 22 is not larger in diameter than hole 12 which is to be grooved and is, preferably, somewhat smaller in diameter, and the protrusion of cutting element 28 radially from body 22 is substantially greater than twice the radial clearance of tool body 22 in hole 12 whereby rotation of the tool in the hole will cause a groove to be formed therein.

The cutting element 28 advantageously comprises a steel support member 32 through which pin 30 extends near one end of the member while mounted on member 32, preferably by brazing, is a hard wear resistant cutting element 34 which may consist of a cemented hard metal carbide, tungsten carbide, for example.

Figure 5:
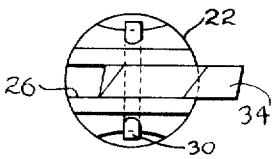
FIG. 5 is a plan view of FIG. 3.
Figure 6:
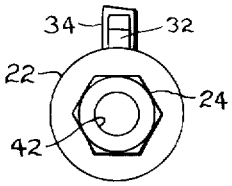
FIG. 6 is a bottom view of FIG. 4.
Figure 7:
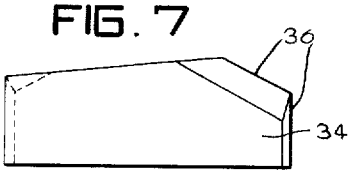
FIGS. 7 and 8 are side and plan views respectively of a wear resistant member forming a part of the tiltable cutting element in FIGS. 3 and 4.
Figure 8:
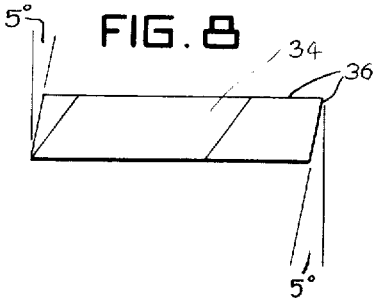
Figure 9:
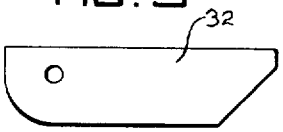
FIGS. 9 and 10 are side and end views respectively of the steel support member on which the aforementioned cutting element is mounted.
Figure 10:
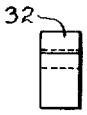

The cutting element 34 is so formed as to present a sharp edge 36 to the surface of the hole when the tool is introduced into the hole and rotated in the counterclockwise direction as it is viewed in FIG. 5.

It will be evident that the cutting element and the tool body comprise cooperating elements of abutment means at 38 and 40 respectively so that when the cutting element tilts downwardly toward its FIG. 3 position, it is halted in a proper working position. The cutting element, however, will freely tilt upwardly to retracted position to permit the tool to be withdrawn from the hole.

If necessary, the tool body can be provided with a passage 42 for the supply of fluid to the region being acted on by the cutting element, or so that suction can be applied through passage 42 to the same region. In this manner, the generation of dust is compensated.

Figure 11:
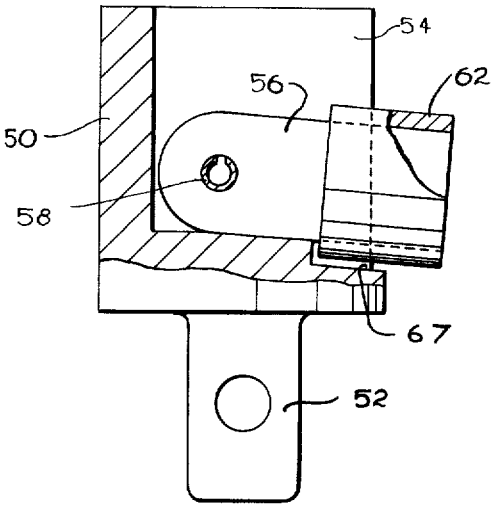
FIG. 11 is a sectional view indicated by line XI—XI on FIG. 12 showing a modification of the tool.
Figure 12:
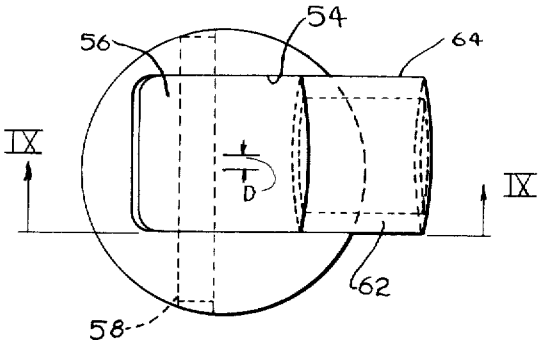
FIG. 12 is a view looking down on top of FIG. 11.
Figure 13:
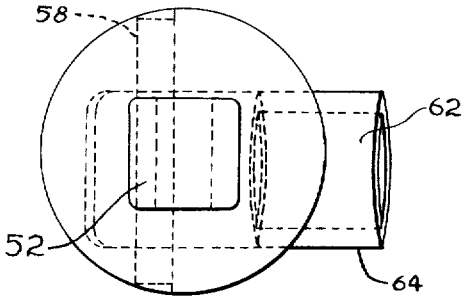
FIG. 13 is a view looking up at the bottom of FIG. 12.
Figure 14:
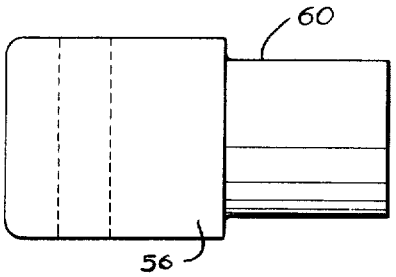
FIGS. 14 and 15 are side plan views respectively of the steel portion of the cutting element forming a part of the FIGS. 11 and 12 modification.
Figure 15:
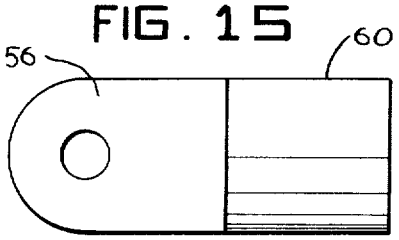
Figure 16:
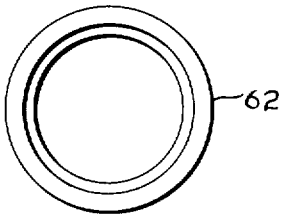
FIGS. 16 and 17 are end and side views respectively of a hard wear resistant sleeve to be mounted on the steel portion of the cutting element illustrated in FIGS. 14 and 15.
Figure 17:
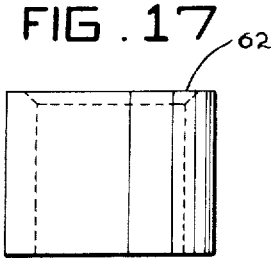
Figure 18:
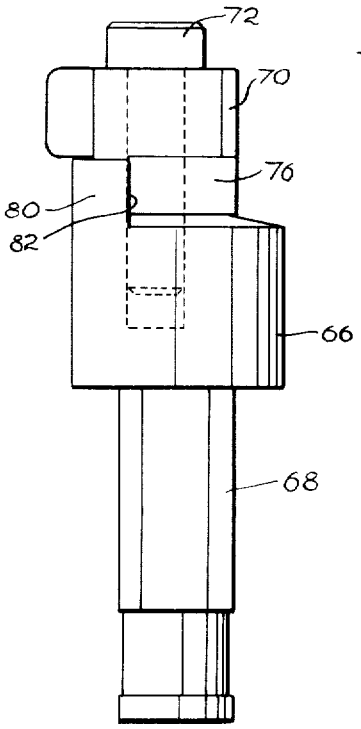
FIG. 18 is a side view of a modified form of the tool in which the cutting element is rotatable on the tool.

FIGS. 11 to 17 show a modification in which tool body 50 has a larger forward end and is provided with a square shank portion 52 projecting axially from the rearward end. Body portion 50 is provided with a rectangular recess 54 extending into one end of the body from the forward end and out one side of the body and displaced radially from the center of the body by an amount D as shown in FIG. 12.

The cutting element in the FIGS. 11 to 17 modification comprises a rod-like steel member 56 having an end portion rectangular in cross section and closely fitting in recess 54 and tiltably held in the recess by pivot pin 58 which extends perpendicularly to the longitudinal axis of the body. The free end of steel member 56 has a round portion 60 formed thereon and mounted on round portion 60, as by brazing or the like, is a hard wear resistant sleeve 62 which may advantageously be formed of a cemented hard metal carbide, such as tungsten carbide.

By offsetting recess 54 radially from the longitudinal axis of the body, it is possible so to dispose the outer end of the cutting element that it attacks the peripheral surface of the hole being treated with the proper clearance. Thus, the tool, as viewed in FIG. 12, when rotated counterclockwise, will cause the leading side 64 of the sleeve 62 to engage the periphery of the hole and form the aforementioned groove therein.

In connection with the first described modification, withdrawing of the tool from the hole will cause the cutting element to tilt upwardly about the axis of pin 58 to substantially within the envelope of the body whereby the tool can readily be withdrawn from the hole after the groove, or grooves, is formed therein.

The forwardly facing bottom wall of recess 54 and the side of steel member 56 form the cooperating elements of abutment means to hold the cutting insert in its radially extended position of FIG. 11. Advantageously, the bottom wall of the recess is notched as at 67 so that the hard wear resistant. sleeve 62 does not engage the bottom wall of the recess and which engagement could conceivably cause fracturing of the sleeve.

Figure 19:
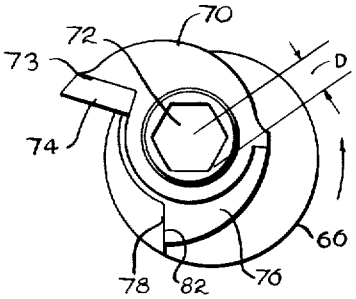
FIG. 19 is a view looking down on top of the tool of FIG. 18 showing the cutting element in the position in which it protrudes on the body of the tool.
Figure 20:
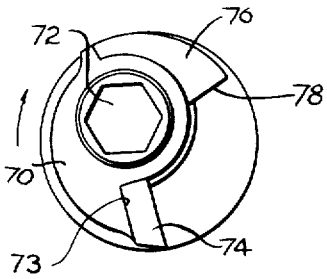
FIG. 20 is a view like FIG. 19 but shows the cutting element in retracted position and disposed substantially within the envelope of the tool body.
Figure 21:
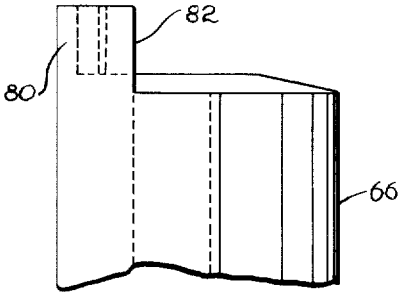
FIG. 21 is a side view drawn at somewhat enlarged scale showing the forward end of the body of the tool of FIG. 18.
Figure 23:
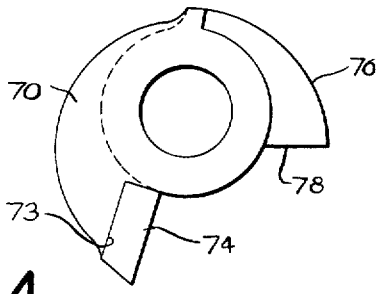
FIGS. 23 and 24 are top and bottom views respectively of the rotatable cutting element of the tool of FIG. 18.
Figure 22:
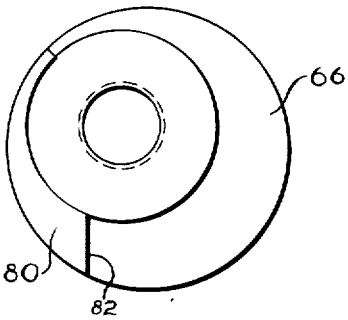
FIG. 22 is a plan view looking down on top of FIG. 21.
Figure 24:
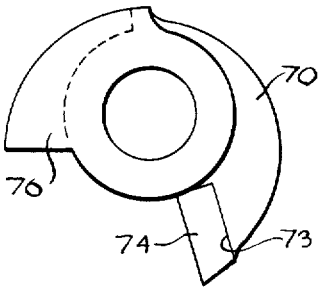
Figure 25:
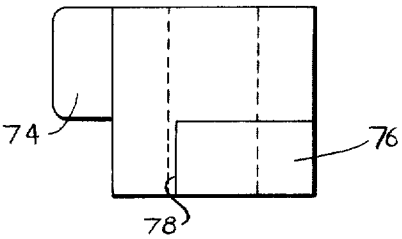
FIG. 25 is a side view of the cutting element of the tool of FIG. 18.

FIGS. 18 to 25 show a further modification in which the cutting element is rotatably supported on the body of the tool. In FIGS. 18 to 25, the body of the tool at 66 has a hexagonal shank 68 projecting from the rearward end and adapted for being received in a drive chuck. At the forward end of the body, there is rotatably mounted cutting element 70. Cutting element 70 is secured to body 66 by pivot bolt 72 which, as will best be seen in FIGS. 19 and 20, is offset from the longitudinal axis of body 66 by dimension D.

The cutting element 70, when viewed in plan as in FIGS. 19, 20, 23 and 24, has a generally spiral configuration with a generally radial axial shoulder at 73 to which is attached a hard wear resistant cutting element 74 such as a cemented hard metal carbide cutting element.

The axially lower portion of the cutting element comprises a protruding cam part 76 which also terminates in a generally radial and axially extending shoulder 78 which forms an abutment surface. The body 66 is formed with an axially projecting portion 80 which is substantially coextensive in the axial direction with the aforementioned shoulder 78 and which presents an abutment surface 82 facing shoulder 78 on the cutting insert.

FIG. 19 shows the cutting insert in operative position and to which position the cutting insert moves when the body 66 is rotated in the counterclockwise direction. When the body is rotated in this direction, the cutting insert will be driven to rotate in the clockwise direction on the body until the shoulders 78 and 82 engage, and it will halt the cutting insert in its FIG. 19 position wherein it protrudes radially outwardly from the cutter body.

FIG. 20 shows the cutter body and cutting insert with the cutting insert rotated to retracted position and which is accomplished by rotating the body in the hole in a clockwise direction and which will cause counterclockwise movement of the cutting insert on the body until the cutting insert falls substantially within the envelope of the body.

In every case, the body of the tool is generally cylindrical and has not more than a predetermined radial clearance in the hole which is to be grooved. The cutting insert protrudes radially from the body of the tool an amount substantially greater than twice the aforementioned predetermined radial clearance and, thus, extends outwardly from the tool body a sufficient distance to form the desired helical groove inside the hole.

In each modification, the cutting element has a second position into which it is moveable in which it falls substantially within the envelope of the tool body thereby permitting easy withdrawal of the tool from the hole in which one or more grooves have been formed.

Modifications may be made within the scope of the appended claims.

What is claimed is:

1. A tool for forming at least one groove in the wall of a hole, especially in a hole in an earth formation, said tool comprising; a block-like body having a longitudinal axis, said body having a forward end and a rearward end, means at the rearward end of said body adapted for engagement by a driver for moving the tool axially and for driving the tool in rotation on the axis thereof, said body being freely receivable in and movable axially along the hole to be grooved, pivot means located near said central axis on the forward end of said body, a cutting element having one end pivotally mounted thereon and having a first pivotal position on said body wherein the other end of said cutting element protrudes radially from the body for forming a groove, cooperating elements of abutment means on said cutting element and said body to support said cutting element in said first position on said body during the forming of a groove, the length of said cutting element which protrudes radially from said body when said cutting element is in said first position thereof on said body being no greater than the length of the cutting element within the envelope of the body, said cutting element having a second position on said body wherein it is disposed entirely within the envelope of said body to permit free axial movement of the tool in the hole, said cutter element being freely movable between said first and second positions thereof and the position of said cutting element on said body being determined by the direction of movement of said body in the hole.

2. A tool according to claim 1 in which the pivot means pivotally connecting said cutting element near one end thereof to said body is on an axis perpendicular to said longitudinal axis of the body, said cutting element extending substantially laterally of said body in said first position of the cutting element and substantially axially of said body in said second position of the cutting element.

3. A tool according to claim 2 in which said cutting element comprises a steel support member having said pivot means therein and a cemented hard metal carbide blade fixed to the side of said support member which faces the forward end of said body when said cutting element is in said first position thereof.

4. A tool according to claim 3 in which said blade has a sharp edge formed along one side of the forward face thereof.

5. A tool according to claim 1 in which said body has a lateral recess formed therein, said cutting element being disposed in said recess.

6. A tool according to claim 5 in which said recess is in the form of a lateral slot formed axially into said body from the forward end thereof.

7. A tool according to claim 5 in which said recess is radially offset from said longitudinal axis in a direction parallel to the axis of said pivot means.

8. A tool according to claim 7 in which said cutting element is a rod-like member of substantial proportions and has a hard wear resistant sleeve element mounted on the outer end thereof.

9. A tool according to claim 1 which further comprises a pivot means pivotally connecting said cutting element near one end thereof to said body, and said pivot means defining a pivot axis parallel to the longitudinal axis of said body and radially offset therefrom, said cutting element comprising a disc-like member rotatable on said pivot means and having a generally radial cutting edge which protrudes from said body in said first position of said cutting element.

10. A tool according to claim 9 in which said body includes an axial abutment on the forward end projecting into at least partly axially coextensive relation with said cutting element, said cutting element having an axial shoulder formed thereon which engages said abutment element in said first position of said cutting element.

* * * * *